United States Patent [19]

Rogers, Jr.

[11] 4,352,628

[45] Oct. 5, 1982

[54] METHOD FOR POSITIONING PORTABLE STRUCTURES

[76] Inventor: William J. Rogers, Jr., 4449 Park Blvd., Oakland, Calif. 94602

[21] Appl. No.: 94,468

[22] Filed: Nov. 15, 1979

Related U.S. Application Data

[62] Division of Ser. No. 840,752, Oct. 11, 1977, Pat. No. 4,200,419.

[51] Int. Cl.[3] ..... B66F 7/12

[52] U.S. Cl. ..... 414/786; 52/127.1; 52/745; 414/12

[58] Field of Search ..... 414/786, 12, 589, 10; 52/745, 127, 299; 254/84, 85; 238/13; 104/273, 274

[56] References Cited

U.S. PATENT DOCUMENTS

| | | | |
|---|---|---|---|
| 178,390 | 6/1876 | Taylor et al. | 254/85 |
| 3,236,400 | 2/1966 | Turturro et al. | 414/12 X |
| 3,321,180 | 5/1967 | Hutchinson | 187/8.59 X |
| 3,679,177 | 7/1972 | Scholz | 254/89 R |
| 3,817,401 | 6/1974 | Becuer | 414/12 |
| 4,089,426 | 5/1978 | Shepparo, Jr. | 414/12 |

*Primary Examiner*—Leslie J. Paperner

*Attorney, Agent, or Firm*—Phillips, Moore, Lempio & Finley

[57] ABSTRACT

A jacking assembly for positioning portable structures, mobile homes or the like includes at least two vertically operating jacks arranged as a pair on an elongated roller bed, which may be arranged in a parallel fashion with a second pair of jacks on a second roller bed. A horizontal operating jack associates one vertically operating jack with the roller bed to provide movement thereto. An adjustable link interconnects the one vertically operating jack on the roller bed so that the movement imposed upon the one vertically operating jack of the pair by the horizontal jack is translated to the other vertically operating jack. A hydraulic control system is provided to selectively actuate individual jacks from a position remote of the roller beds. A method is disclosed to use with the assembly to remove rack and warp from portable structures during positioning.

2 Claims, 10 Drawing Figures

+X
+Y
+Z
22
88
82
96
92
94
26
86
84
90
70
64
66
68
16
18
54
56
20

METHOD FOR POSITIONING PORTABLE STRUCTURES

This is a division of Ser. No. 840,752, filed Oct. 11, 1977, now U.S. Pat. No. 4,200,419, filed Apr. 29, 1980.

BACKGROUND OF THE INVENTION

This invention relates to a means for and a method of positioning mobile homes or prefabricated buildings in a side-by-side arrangement. In particular, it relates to a portable jacking system which may be used to move a mobile home or the like in a lateral fashion, while retaining a capability of leveling the mobile home while simultaneously removing rack or warp imparted to the structure during road transport.

Structures which are transportable over the road either on self contained wheels or on a trailer for ultimate use as a domicile or the like may be positioned proximate a predetermined site by the delivering vehicle. However, terrain conditions and the necessity in many cases of positioning two structures in a side-by-side relationship precludes the use of the delivering vehicle for accurate positioning of the structure. After leveling a permanent foundation must be installed relative to the structure in order to have a stable platform.

During transport of the structure it is quite common for wind forces and the like to cause a set back or rack so that on arrival at the predetermined site leveling of the floor does not result in the vertical walls being in plumb. In addition to rack, the structure may also warp by rotation about the longitudinal axis during the road transport phase. In any event, the warp or rack must be eliminated before the structure is suitable for habitation.

Commonly, individually positionable hydraulic jacks are utilized to level such structures. However, these vertically operating hydraulic jacks do not permit lateral movement of the structure. In a side-by-side placement, positioning of the first structure may be generally accomplished by the delivering vehicle with leveling being done by hydraulic jacks. However, after placing the first structure at a predetermined site, it is a difficult task to position a second structure adjacent to the first structure sufficiently close so that the two may be joined together for use as a single structure without the use of some means for moving one or the other of the structures laterally. In addition to the necessity of lateral movement, it is appropriate, and in some cases necessary, to remove road wheels affixed to the structure before the relatively permanent installation is completed. In order to accomplish wheel removal the structure must be raised from the ground sufficiently high to permit such removal.

Thus, it can be seen that a contractor in positioning a number of structures, which may be mobile homes, must be able to move the structures longitudinally, which may be done through the use of a tow truck or the like. He must also be able to move the structure laterally. He must also be able to raise or lower the structure to level the structure and to remove the road wheels if installed. As noted above, many devices have been available to accomplish one or more of the above functions. However, such devices usually are missing one or more of the features just enumerated. Accordingly, it may be necessary to use several devices to position such homes.

In addition to the desirability of having the motions set forth above available for use by the contractor, it is desirable to be able to eliminate warp or rack which may have been imposed on the structure during the transporting phase.

As noted, earlier devices have provided several of these features; however, there are other attributes needed in mobile home positioners that do not exist in presently available devices. For example, portable structures or mobile homes are quite frequently placed in areas of soft earth precluding the use of an ordinary hydraulic jack without a large pad placed beneath the jack to prevent the jack from sinking into the soft terrain. Although, some devices have used tracklike structures upon which jacks may be positioned or permanently fixed, such structures have been cumbersome. Where the jacks have been permanently affixed to the tracklike structures, the portability may be degraded to the extent that power driven wheeled devices must position the structure.

In other cases, a rail member, which contacts the lower surface of the portable structure or the mobile home, is positioned above the jacks so that the relatively small bases of the jacks contact the ground. In a manner similar to the devices previously described, the subtending jacks may be permanently affixed to the rail structure, thus increasing the overall weight, and degrading portability and easy placement of the jack structure under the portable structure.

In other cases, the positioning devices have included rather elaborate tracks upon which the portable structure may be rolled. Use of such tracks accomplishes the positioning of the structure but the tracks must be set up thus lengthening the overall positioning time. Such lengthening of the positioning time increases costs. In one device, the track structure has been made relatively more portable so that members having rollers on the bottom thereof may be utilized to position a trailer longitudinally. In this relatively more portable track structure, the rolling member is supported a relatively long distance above the terrain thus precluding the use of a vertical jack while positioning relatively low portable structures.

SUMMARY OF THE INVENTION

This invention overcomes the shortcomings set forth above relating to the previous devices utilized in setting portable structures or mobile homes.

The invention includes an elongated roller bed assembly upon which a first vertical jack assembly is also mounted for movement on the roller bed assembly remote of the first vertical jack assembly. A link member interconnects the first and second vertical jack assemblies for simultaneous movement thereof. A horizontal jacking device associates the first vertical jack assembly with the roller bed assembly and is selectively actuable for causing the first jack assembly to move on the roller bed assembly.

DETAILED DESCRIPTION OF THE PREFERRED EMBODIMENT

Figure 1:
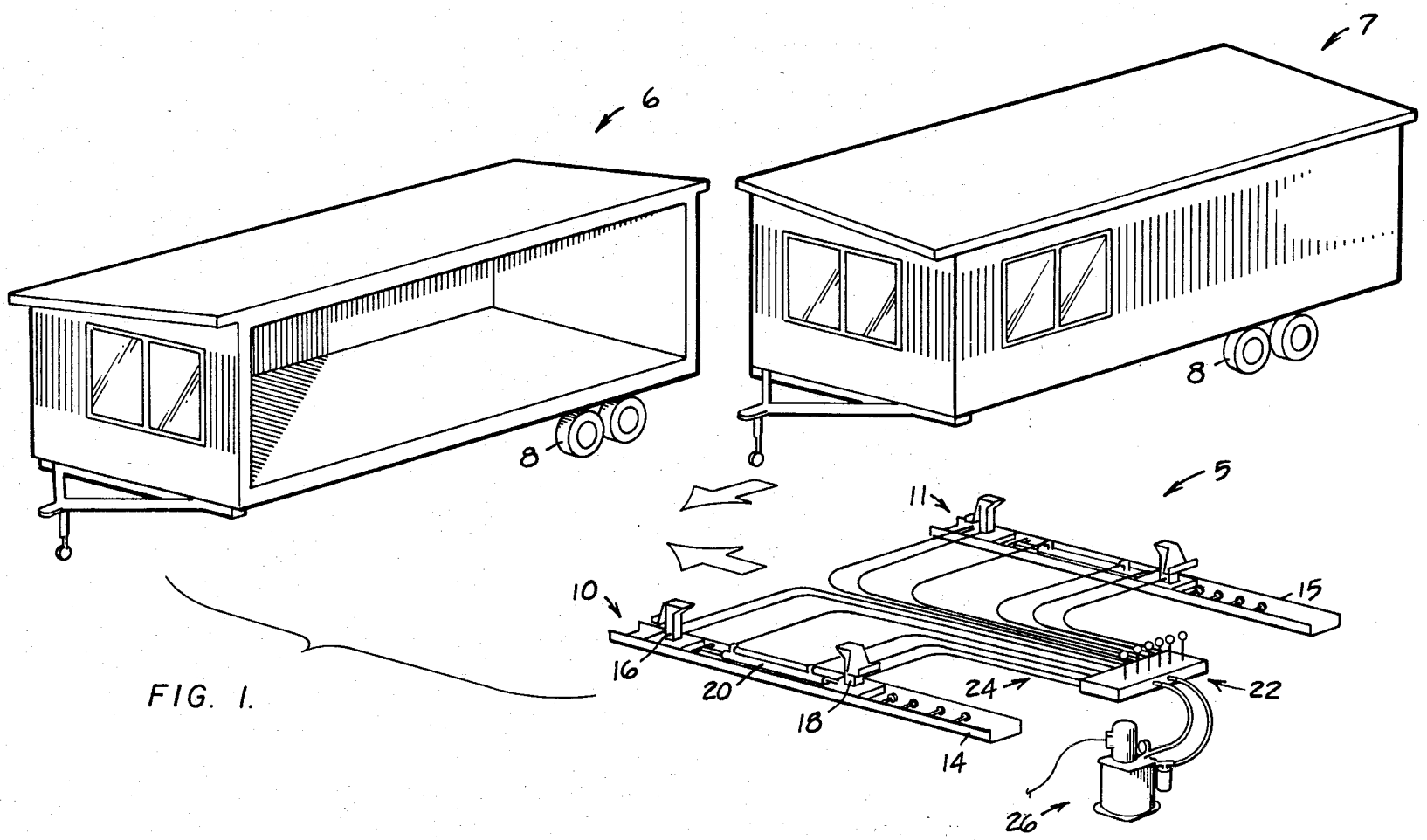
FIG. 1 is a perspective view of the mobile home positioning system located adjacent to two mobile homes and in condition to be positioned underneath one of the mobile homes.

Referring now to FIG. 1, a mobile home positioning system is shown in perspective relative a first mobile home 6 and a second mobile home 7. While reference is made here to a mobile home, it should be understood that this invention is equally applicable to any portable type structure which may be moved from one site to another either on attached wheels 8 or on a truck (not shown).

The mobile home positioning system 5 is comprised of a pair of substantially identical jacking assemblies 10 and 11. Each jacking assembly such as jacking assembly 10 is comprised of an elongated roller bed member 14, a first vertical jack 16, a second vertical jack 18 and a horizontal jack 20. The horizontal jack, as will be seen in the subsequent discussion, provides for movement of the two vertically oriented jacks along the roller bed member. Since each jack member in each of the jacking assemblies 10 and 11 may be hydraulically operable, a master valve assembly 22 feeds the plurality of flexible conduits 24 associated with the six jacks and communicates pressurized fluid selectively from a pump, 26 which may include filter means and relief valve means.

Figure 2:
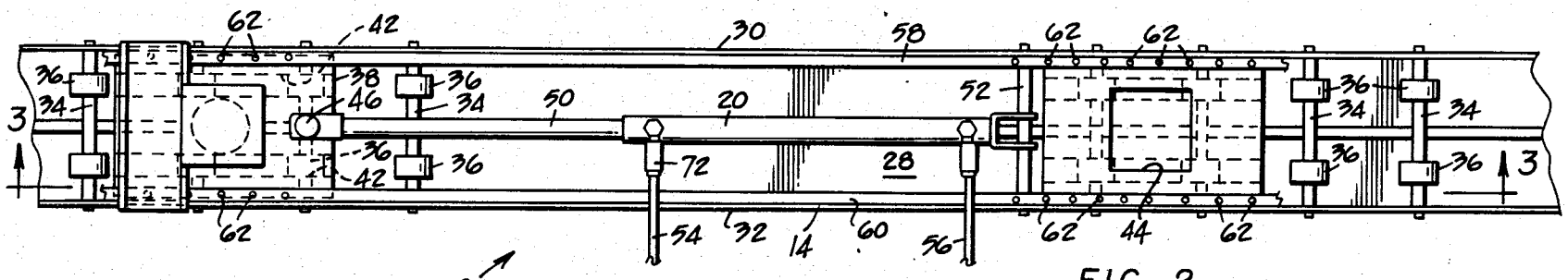
FIG. 2 is a plan view of a portion of the mobile home positioning system shown in FIG. 1.
Figure 4:
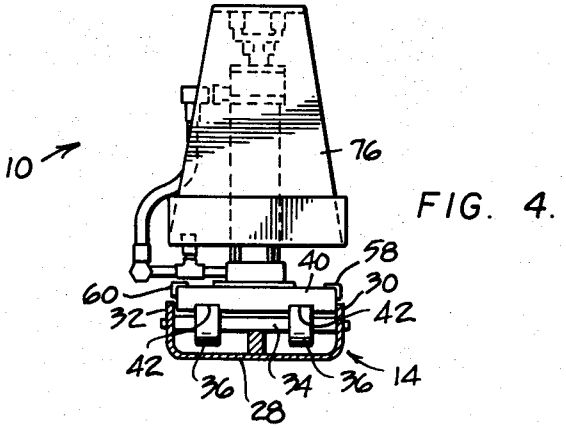
FIG. 4 is a sectional view of the mobile home positioning system shown in FIG. 3 and taken at Section line 4—4.
Figure 3:
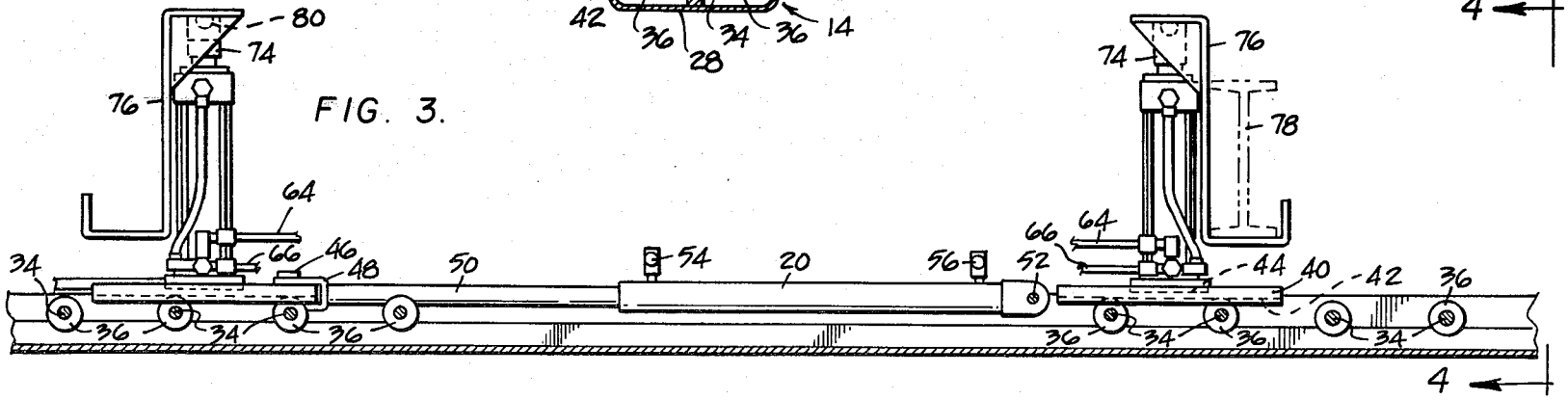
FIG. 3 is an elevation view at section line 3—3 of FIG. 2 of the portion of the mobile home positioning system shown in FIG. 2.

Referring now to FIGS. 2, 3 and 4, jacking assembly 10, which as previously noted is substantially identical to jacking assembly 11 is shown in greater detail. Since jacking assemblies 10 and 11 are substantially identical, the description which ensues relating to jacking assembly 10 is equally applicable to jacking assembly 11.

Elongated roller bed 14 may be constructed unitarily as indicated in FIG. 4 in a U shape so that the bottom portion, 28, may rest on the terrain. To reduce weight the roller bed may be of a light weight metal such as aluminum or magnesium. Disposed between the upstanding side portions 30 and 32 are a plurality of axle members 34 upon which rollers 36 are rotatably mounted. Appropriate bearings means such as roller bearings or sleeve bearings may be utilized between rollers 36 and axle 34. Alternatively, the rollers themselves may be roller bearings. It has been found appropriate to use at least two rollers on each axle. As can be seen in FIG. 3, it has also been found appropriate to group axles 34 with a plurality at one end of roller bed member 14 and a second plurality at the other end of the roller bed member. The two groupings of axles may span the normal lateral separation between frame members of generally available portable buildings, or mobile homes. It should be understood, that additional axles and rollers may be added to the roller bed members commensurate with the particular type of portable building being positioned.

Mounted above one group of the plurality of rollers 36 is a first jack pad 38 and above the other group a second jack pad 40 each for receiving the first and second vertical jacks 16 and 18 respectively. The first and second jack pads are similar in construction and differ only in one detail which will become apparent in the discussion. Referring to FIG. 4, the second jack pad is shown in an end view to specifically illustrate grooves 42 formed in the lower surface thereof to receive rollers 36. The first jack pad is similarily formed as indicated in FIG. 2. It will be noted in FIG. 2 that the second vertical jack 18 is not shown in order to show a relieved area 44 in which the second vertical jack 18 may be positioned. A similar relieved area may be formed in the upper surface of the first jack pad. It should be noted that relieved area 44 should not be considered limited to a square shape. Further, the relieved area 44 is not a limiting factor in the invention as the vertical jacks may be positioned on the jack pads by other means such as bolts or the like.

First jack pad 38 differs from second jack pad 40 in that it is formed for connection with horizontal jack 20 and therefore, may be formed to receive a pin 46 which may pass through a bifurcated end 48 of rod 50 of the horizontal jack. Pin 46 serves to couple rod 50 with the horizontal jack which in turn is pivotally fixed to roller bed member 14 by a transverse rod 52 proximate the groups of rollers 36 upon which the second jack pad 40 rests.

Horizontal jack 20 preferably is in the form of a double acting hydraulic cylinder with a conduit 54 communicating hydraulic fluid to the rod end and a conduit 56 communicating hydraulic fluid to the head end.

Means are provided to interconnect first jack pad 38 with second jack pad 40. In this particular embodiment, a pair of elongated rods 58 and 60 are provided with plurality of holes proximate each end thereof, through which appropriate fastening means such as bolts or the like may pass to interconnect with the first jack pad or the second jack pad as appropriate. The plurality of holes 62 allows for differing separating differences between that the first and second jack pad to accommodate variations in frame separation of differing portable structures.

The first vertical jack 16 and second vertical jack 18 are substantially identical in construction. Therefore, first vertical jack 16 will be discussed in some detail with the details being appropriate to the second vertical jack. The first vertical jack may be a double acting hydraulic cylinder with fluid provided to the rod end, which extends upwardly from the cylinder, by conduit 64 and to the head end by a conduit 66. A pilot operated check valve 68 (see FIG. 5) is provided upstream of the head end of the vertical jack to prevent leakage and consequently undesirable lowering of a load being carried by the jack. The pilot operated check valve is operable to relieve pressure in the head end of the cylinder 16 upon pressurization of line 64 and the concurrent pressurization of pilot line 70 which opens the check valve. Thus fluid contained in the head end of the jack 16 is relieved only upon actuation of the valving system to provide pressurized fluid to the rod end. This same valving structure is available in the second vertical jack 18.

The conduits described, that is conduits 54, 56, 64 and 66 and the like conduits on the similarily formed jacking assembly are all interconnected with the jacking members by appropriate fittings such as quick disconnect fittings 72. Through the use of quick disconnect fittings and flexible conduit, the entire jacking system as shown in FIG. 1, may be rapidly assembled for use or disassembled for placement in the back of a small truck for transport.

Each vertical jack is fitted at the rod end with an appropriate fitting 74 which is adapted to receive a generally 's' shaped bracket 76. Bracket 76 is adapted to receive a framing member of a portable structure or mobile home. A framing member 78 is shown in FIG. 3 in second vertical jack 18 in phantom and does not form a portion of this invention. Bracket 76 is representative only and may be modified to fit the structure to be positioned. In the particular embodiment shown herein bracket 76 is swung from the fitting 74 by a semi-circular pin 80 integrally formed with the bracket and allowing a certain amount of rotational freedom as shown in FIG. 3.

Figures 5, 6, 7, 8, 9, 10:
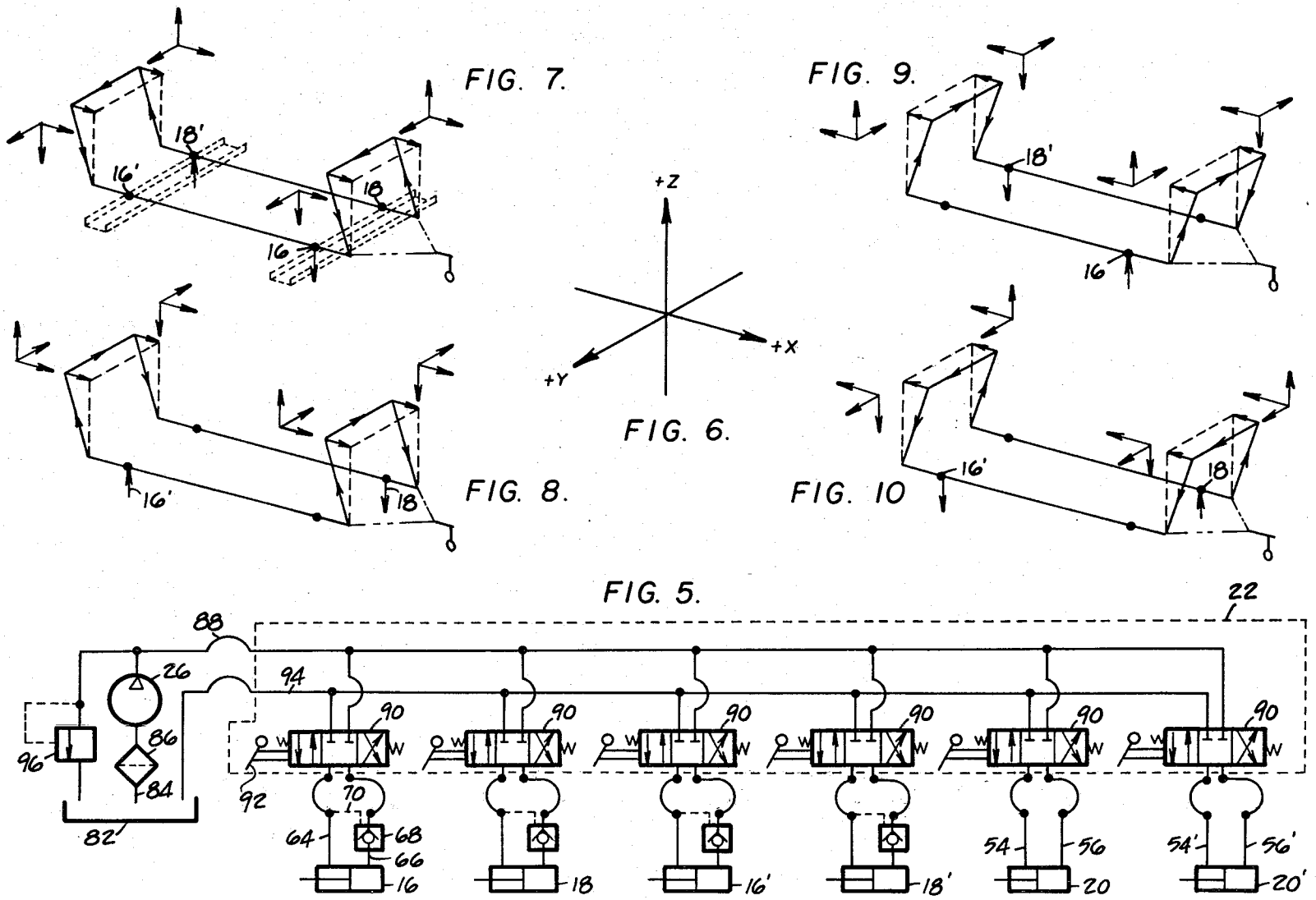
FIG. 5 is a schematic diagram of a hydraulic circuit which may be used to operate the various jacks in the assembly described herein.
FIG. 6 is a perspective of a three dimensional axis system which is used to describe the orientations of FIGS. 7, 8, 9 and 10.
FIG. 7 is a schematic representation of a portable structure wherein the vertical members are out of plumb in the negative x direction and the negative y direction.
FIG. 8 is a schematic representation of a portable structure wherein the vertical members are out of plumb in the negative x direction and the positive y direction.
FIG. 9 is a schematic representation of a portable structure wherein the vertical members are out of plumb in the positive x direction and the positive y direction.
FIG. 10 is a schematic representation of a portable structure wherein the vertical members are out of plumb in the positive x direction and the negative y direction.

Referring now to FIG. 5, a schematic representation of a hydraulic system which would be appropriate for use in this jacking system is illustrated. For convenience sake the first and second vertical jacks 16 and 18 associated with roller bed member 14 are as illustrated. The first and second vertical jacks associated with roller bed member 15 which is a portion of the second jacking assembly 11 are indicated with a prime as 16' and 18'. This same convention holds true for the horizontal jacks 20 and 20'. The hydraulic system illustrated in FIG. 5 is comprised of a source of fluid 82 which may be a hydraulic fluid well known in the art. A conduit 84 feeds a filter 86 which in turn is connected with pump 26. Pump 26 provides fluid through a flexible conduit 88 to the master valve assembly 22 shown as a dashed line box in FIG. 5. The master valve assembly 22 includes six, three position 4-way valves each indicated as a valve 90 in FIG. 5. Each valve 90 is biased to a closed or first position as indicated in FIG. 5 and may be operable by a lever 92 for movement to second and third positions to provide pressurized fluid to the rod and head ends of the jacks respectively. Each three position 4-way valve controls one of the six hydraulic jack members. As previously discussed the vertical jack 16, 18, 16' and 18' include a pilot operated check valve 68 in the conduit feeding the head end thereof. The horizontally oriented jacks 20 and 20', on the other hand, are fed directly from their respective three position 4-way valves. Each three position 4-way valve is connected to a common return line 94 to communicate fluid back to source 82. A conventional relief valve 96 may be provided on the pressure side of pump 26 to control pressure to the master valve assembly 22.

Although general operation of structure just described should be apparent to those skilled in the art, the following discussion is offered for further clarification and to set forth a method for removing rack from a portable structure. Referring to FIG. 1, the first portable structure, hereinafter a mobile home, is generally positioned by a towing vehicle (not shown) in the desired site. However, in some instances, it is necessary to reposition the first mobile home. Therefore, the jacking assemblies 10 and 11 may be positioned under the first mobile home in the following manner. The first roller bed member 14 is positioned forward of the wheels 8 and perpendicular to the longitudinal axis of the first mobile home. The second roller bed assembly 15 is placed behind the wheels 8 also perpendicular to the longitudinal axis of the mobile home. Each vertical jack member 16, 16' 18 and 18' may then be positioned underneath the mobile home so that the frame members 78 of the mobile home are in alignment with the appropriate bracket 76 associated with each vertical jack member. It is assumed that the hydraulic conduits interconnecting the various jacking elements have been properly connected to the master valve assembly 22. It has been found in practice that color coding of the hydraulic lines facilitates a proper connection of the lines to the appropriate jack. Having properly connected the various flexible conduits to the proper jack, selective operation of the six, three position 4-way valves 90 provides the contractor with the ability to raise or lower each individual vertical jack selectively while allowing a movement of the pairs of jacks 16 and 18 and 16' and 18' selectively and longitudinally along roller bed member 14 and 15 respectively. Thus, the first mobile home 6 may be repositioned transverse to its longitudinal axis while leveling the floor of the mobile home. It should be apparent to those skilled in the art that by turning the entire positioning system 5 ninety degrees, that motion parallel to the longitudinal axis of the mobile home may be accomplished in a like manner. In this mode, if the wheels 8 are available the wheels 8 may be utilized as a balance point with the jacks 20 operable to move the mobile home in the longitudinal direction.

Referring now to FIGS. 7, 8, 9 and 10, it is common for mobile homes or portable structures to arrive at the final site in a racked or warped condition. Use of the jacking assemblies described herein has shown that, to a great degree, the rack or warp present in a newly arrived mobile home may be taken out by selective jacking. This, as shown in FIG. 7, where the vertical jacks 16, 18 and 16', 18' are shown schematically as small circles, the roller bed member 14 is at the front end of the trailer thus positioning vertical jacks 16 and 18 as indicated at the front end of the trailer and roller bed 15 with jacks 16' and 18' is at the back end of the trailer. Selective operation of the jack 18' in the upward direction while relieving the head end of jack 16 causes the mobile home to rotate in the positive x direction and the positive y direction as indicated in the coordinate system of FIG. 6. Concurrently, the right-hand side of the trailer at the front end will drop while the left-hand back side raises. This asymetric load on the trailer frame relieves the rack or warp. Appropriate checking with plumb bobs and levels will work the rack or warp out of the mobile home. If the rack is as indicated in FIG. 8, that is the rack is in the positive y direction and the negative x direction, lifting the jack 16' while relieving jack 18 causes the mobile home to rotate as indicated in FIG. 8, that is, in the positive x direction and the negative y direction. In FIG. 9, relieving of jack 18' while raising jack 16 causes the mobile home to rotate in the negative x direction and the negative y direction. Finally, in FIG. 10, relieving the jack 16' and raising the jack 18 causes the mobile home to rotate in the positive y direction and the negative x direction. It can be seen, that with an experienced operator, rack and warp in a mobile home resulting from transporting the mobile home to the desired site may be substantially removed by selective actuation of the jacking members described in relation to this invention.

Having positioned the first mobile home 6, the second mobile home which is generally located in the vicinity of the first mobile home may be positioned. As indicated in FIG. 1, the second mobile home would be positioned generally adjacent the first mobile home 6, as shown by the arrow in FIG. 1. The first and a second jacking assemblies 10 and 11 would be positioned in the manner previously described in relation to the first mobile home so that the second mobile home could be similarily moved laterally and aligned with the first mobile home. It should be understood that the wheels 8 may be removed from each mobile home once it is in the desired final setting position. The operation described in relation to the first mobile home to relieve rack or warp from the structure may be used with the second mobile home.

It should be apparent to those skilled in the art that once the mobile home is positioned the structure must be permanently fixed to foundation blocks. Although, foundation blocks are not shown in this application, the method utilized to position the structure on the blocks usually starts at the back end or the right-hand end of each mobile home as indicated in FIG. 1. The initial foundation blocks are placed along the rear wall and adjusted upwardly to engage the frame members. Additional foundation members are placed under the frame members moving forwardly from rear end of the mobile home while relieving hydraulic jacks, 16' and 18'; 16 and 18 in that order as the permanent blocks are placed. During the entire operation the floor level of each mobile home is carefully checked along with the plumb of the vertical members. Once the two mobile homes are properly set on the permanent foundation, fastening together of the two mobile houses may take place. It should be understood the first mobile home 6 may be positioned before alignment of the second mobile home 7 with the first mobile home. Thus, it is not necessary to have two complete positioning assemblies.

Although, this invention has described in relation to a single embodiment, it should be understood to those skilled in the art that variations and modifications to the structure herein should be considered within the scope of the invention.

Embodiments of the invention in which an exclusive property of privilege is claimed are defined as follows:

1. A method of positioning two portable structures in a side by side contiguous relationship comprising the steps of:

(1) moving the first portable structure to a predetermined position (2) leveling the first portable structure (3) putting the vertical members of the first portable structure into plumb by supporting the first portable structure asymmetrically so that the structure simultaneously rotates about the longitudinal and about the lateral axis while concurrently observing the plumb of the vertical members of the first portable structure (4) moving the second portable structure along its longitudinal axis to a position adjacent the first portable structure (5) moving the second portable structure laterally to a position contiguous the first portable structure (6) leveling the second portable structure (7) moving the plane of the floor of the second portable structure into the plane of the floor of the first portable structure (8) putting the vertical members of the second portable structure into plumb by supporting the second portable structure asymmetrically so that the structure simultaneously rotates about the longitudinal and about the lateral axis while concurrently observing the plumb of the vertical members of the second portable structure.

2. A method of positioning two portable structures in a side-by-side contiguous relationship comprising the steps of:

(1) moving the first portable structure to a predetermined position;

(2) levelling the first portable structure;

(3) putting the vertical members of the first portable structure into plumb by temporarily asymmetrically supporting the first structure adjacent at least three corners thereof;

(4) moving the second portable structure along its longitudinal axis to a position adjacent the first portable structure;

(5) moving the second portable structure laterally to a position contiguous the first portable structure;

(6) levelling the second portable structure;

(7) moving the plane of the floor of the second portable structure into the plane of the floor of the first portable structure;

(8) putting the vertical members of the second portable structure into plumb by temporarily asymmetrically supporting the second structure adjacent at least three corners thereof.

* * * * *